US005545859A

United States Patent [19]

Ullrich

[11] Patent Number: 5,545,859

[45] Date of Patent: Aug. 13, 1996

[54] ANTI-VIRAL ACOUSTICALLY TRANSPARENT EARPHONE COVER

[76] Inventor: Kenneth A. Ullrich, 4369 Anna La., Wenatchee, Wash. 98801

[21] Appl. No.: 206,971

[22] Filed: Mar. 7, 1994

[51] Int. Cl.[6] ..... H04R 25/00

[52] U.S. Cl. ..... 181/129

[58] Field of Search ..... 181/129, 130, 181/131, 135, 137; 2/209; 379/451, 452

[56] References Cited

U.S. PATENT DOCUMENTS

| | | | |
|---|---|---|---|
| 3,122,613 | 2/1964 | Gongoll et al. . | |
| 3,169,171 | 2/1965 | Wachs et al. | 379/452 |
| 3,645,354 | 2/1972 | Kliewer . | |
| 4,071,717 | 1/1978 | Fidi et al. . | |
| 4,160,135 | 7/1979 | Gorike . | |
| 4,239,945 | 12/1980 | Atoji et al. . | |
| 4,465,907 | 8/1984 | Minear et al. . | |
| 4,529,057 | 7/1985 | Telford . | |
| 4,546,215 | 10/1985 | Ferraro . | |
| 4,570,038 | 2/1986 | Tinelli | 379/452 |
| 4,572,324 | 2/1986 | Fidi et al. . | |
| 4,584,718 | 4/1986 | Fuller . | |
| 4,649,570 | 3/1987 | Terbrack et al. . | |
| 4,654,898 | 4/1987 | Ishikawa . | |
| 4,660,229 | 4/1987 | Harris | 2/209 |
| 4,677,678 | 6/1987 | McCutchen . | |
| 4,699,129 | 6/1987 | Chance . | |
| 4,711,454 | 9/1988 | Wilcox, Jr. . | |
| 4,727,599 | 2/1988 | Rappaport et al. . | |
| 4,830,138 | 3/1989 | Palmaer et al. . | |
| 4,871,046 | 10/1989 | Turner | 181/131 |
| 4,924,502 | 3/1990 | Allen et al. . | |
| 4,953,215 | 8/1990 | Weiss et al. . | |
| 4,953,703 | 9/1990 | Virginio | 379/452 |
| 4,972,491 | 11/1990 | Wilcox, Jr. . | |
| 5,001,763 | 3/1991 | Moseley . | |
| 5,022,100 | 6/1991 | Belanger . | |
| 5,365,023 | 10/1994 | Lawton | 181/131 |

*Primary Examiner*—Khanh Dang

*Attorney, Agent, or Firm*—Kolisch Hartwell Dickinson McCormack & Heuser

[57] ABSTRACT

An earphone cover, for attachment to an operative region of an audiometric testing device includes a body formed from a substantially antiviral, acoustically-transparent material, and is constructed for covering such operative region. The body is preferably formed as a polyethylene film with a thickness of about 1-mil. Anti-viral testing shows that the earphone cover is an effective barrier throughout a 60-minute exposure time to a viral organism described as ϕX174 bacteriophage ATCC# 13706-B1. Acoustic transparency testing shows the earphone cover exhibits acceptable % total harmonic distortion and attenuation. A method of preventing patient cross-contamination associated with audiometric testing is also described. Both the structure and method are usable without affecting calibration of the audiometric testing device.

5 Claims, 2 Drawing Sheets

ANTI-VIRAL ACOUSTICALLY TRANSPARENT EARPHONE COVER

BACKGROUND AND SUMMARY OF THE INVENTION

The present invention relates generally to audiology. More particularly, the invention concerns a novel anti-viral, acoustically transparent earphone cover.

With the onset of communicable diseases such as AIDS it has become necessary for various health care professionals to consider patient cross-contamination at a heightened level. For some time there has been a demand for protection from all forms of patient cross-contamination. Certain health-care-related procedures that were not seen to pose a risk of such cross-contamination in the past are now being reviewed in light of AIDS awareness and prevention.

An example of such procedures is the usual audiometric test procedure for determining whether a patient has an acceptable level of hearing. Such procedures are performed using a conventional audiometric testing device that includes an audiometer earphone headset which is connected to conventional sound testing equipment that transmits audiometer-test sounds to the earphone of the headset.

Patient cross-contamination arises because the cushions and headband portions of all audiometer earphone headsets come in contact with the patient's ears and head. Conventional approaches have included applying a disinfectant solution to such cushions and/or headband portions prior to each use. Those approaches have been unsatisfactory, in part because time constraints and inconvenience frequently preclude disinfecting the earphone cushion and headbands.

Alcohol and zepherine, conventional disinfectant solutions, damage the earphone transducer, and residual solution remaining on the cushion is bothersome to the patient. Alcohol dries and hardens the earphone cushion. Wet sanitary cloths suffer from the same disadvantages.

Another approach, to drape the patient's head and ears with a conventional nursing cap, conceals the ear from view thus preventing necessary, accurate centering of the earphone directly over the meatus (the small opening into the ear). Without proper centering, audiometric calibration accuracy is jeopardized.

Accordingly, it is a principal object of the present invention to provide apparatus and method that overcomes the drawbacks of prior-art systems.

Yet another object is to provide such apparatus and method that can be used without affecting calibration of the audiometer.

Another object is to provide such apparatus and method that provides a safe test environment for patients of audiologists.

Yet another object is to provide such apparatus and method for repeatedly sterilizing those sections of audiometric devices which come into contact with patients' ears.

Another important object of the invention is to provide such apparatus and method that is lightweight and comfortable for the patient.

Still another object is to provide such method that is not time-consuming.

It is also an object of the invention to provide such apparatus and method that can be cost-effectively manufactured and practiced, respectively.

In brief summary, one aspect of the invention includes a prophylactic structure for attachment to an operative region of an audiometric testing device. The structure includes a body formed from a substantially anti-vital, acoustically-transparent material, and constructed for covering such operative region. Preferably the structure is formed as a polyethylene film having a thickness of about 1-mil.

Another aspect of the invention includes a cover for use with an earphone having dual pads each for resting against a human ear. The cover includes a substantially anti-viral, acoustically-transparent film, and a closure device attached to the film for releasably enclosing the pad with the film, thereby attaching the cover thereto.

With respect to the acoustic transparency of the invention, the structure, or cover, exhibits insignificant distortion and attentuation. With respect to distortion, the following approximate ranges of % in total harmonic distortion (THD) at the following frequencies when the structure is placed over the operative region of such an audiometric testing device, with the hearing level setting of that device being set at 100 dB:

| FREQUENCY KHz | % DISTORTION (THD) |
|---|---|
| 1 | 0.4–0.6 |
| 2 | 0.2–0.4 |
| 4 | 0.1–0.3 |

Another aspect of the invention includes a method of preventing patient cross-contamination associated with audiometric testing that utilizes an earphone headset with opposing earphones, each to be centered over the meatuses of a patient's ears. The method includes the steps of (1) selecting a material having substantially anti-viral, acoustically transparent properties, (2) forming the material into two earphone covers, and (3) placing each cover over a corresponding one of the patient's ears.

These and other objects and advantages of the invention will be more clearly understood from a consideration of the accompanying drawings and the following description of the preferred embodiment.

DETAILED DESCRIPTION OF THE PREFERRED EMBODIMENT

Figure 1:
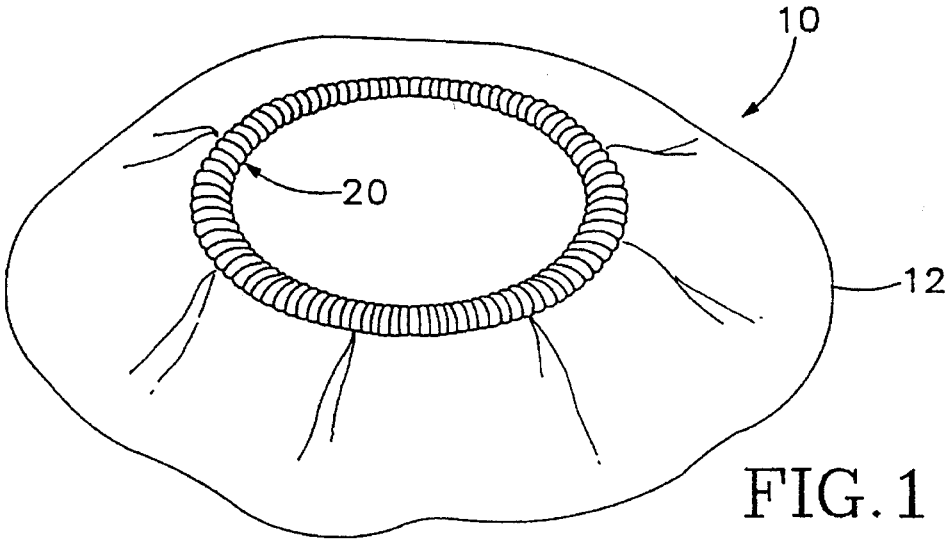
FIG. 1 is an isometric view showing the preferred embodiment of the prophylactic structure of the present invention.

FIG. 1 depicts an isometric view of the prophylactic structure of the present invention, being made in accordance with its preferred embodiment and indicated at 10. Structure 10, which may also be referred to as an earphone cover, includes a body 12 formed from a substantially anti-viral, acoustically-transparent material. The presently preferred material is polyethylene, and body is preferably formed as a film of that material with a thickness of approximately 1-mil. With respect to the acoustically-transparent feature of the invention, other materials may include fabric, polypropylene, NYLON® polyamide polymers.

Figure 2:
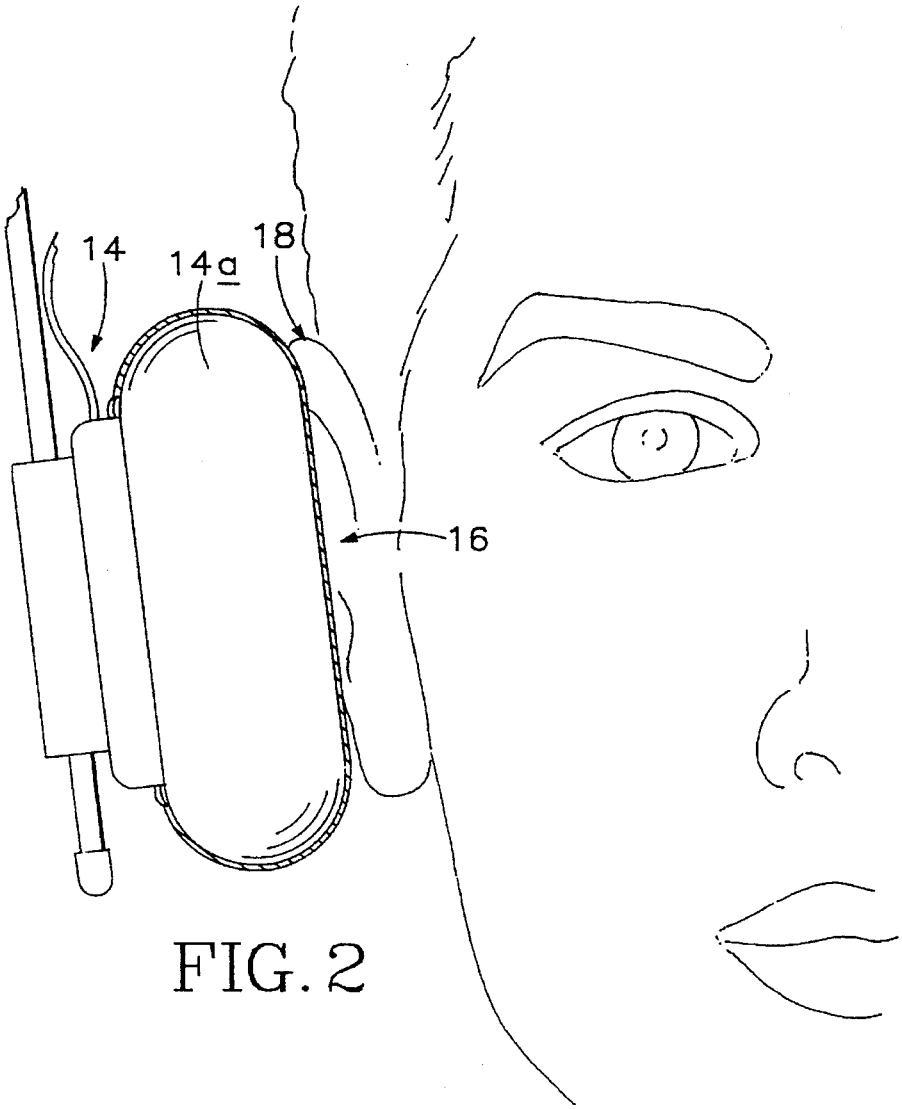
FIG. 2 shows, on a somewhat reduced scale, the prophylactic structure of the present invention in position on an earphone.
Figure 3:
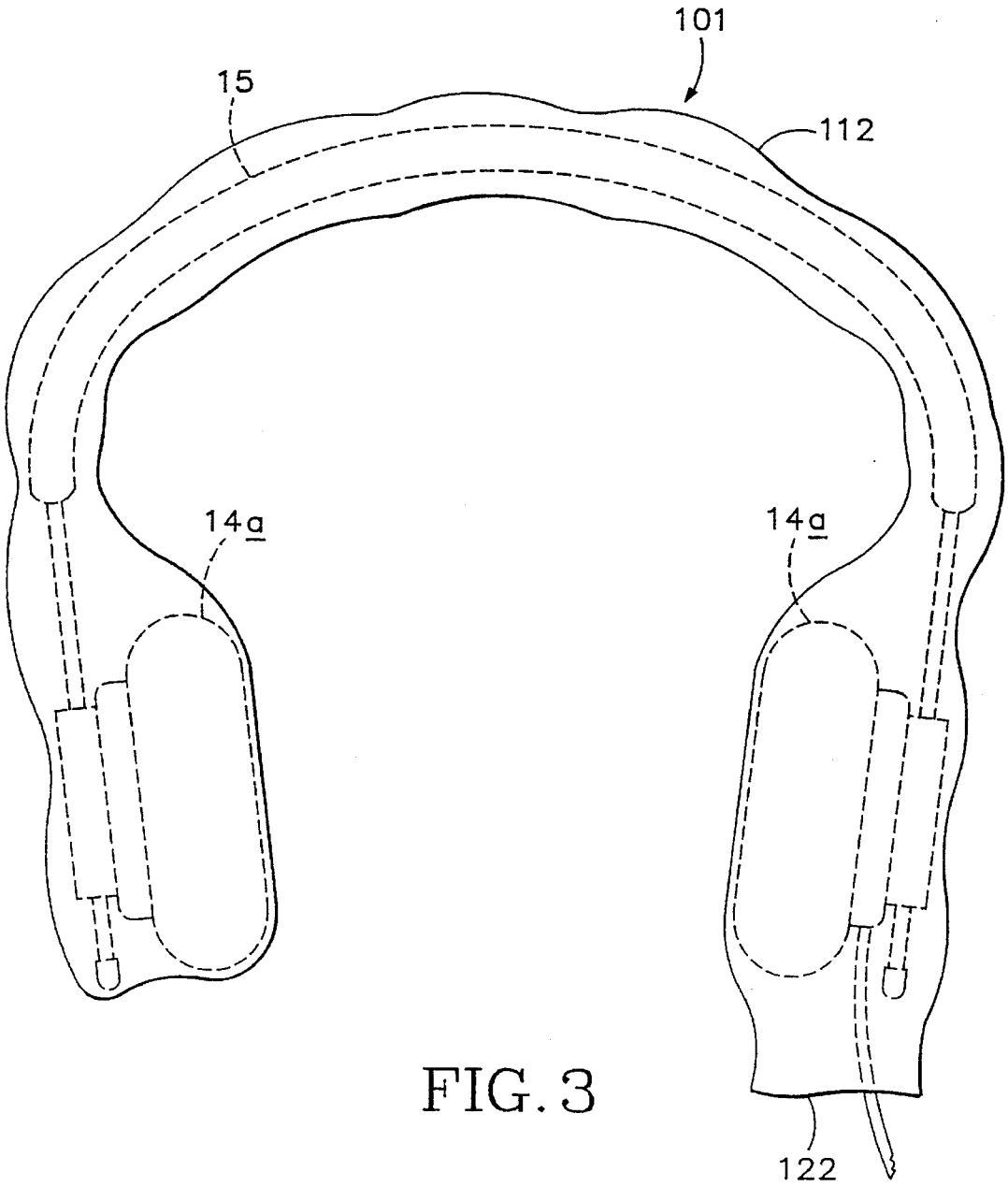
FIG. 3 is like FIG. 2 except that it also shows how the structure of the present invention will cover an operative region that includes at least a section of the headband that forms part of a conventional audiometric testing device.

Referring to FIG. 2, cover 10 is attachable to an audiometer headset of a conventional audiometric testing device 14 at an operative region 14*a*. The operative region is preferably the earphone component of that device. The sound testing equipment of the conventional audiometric testing device is not depicted in FIGS. 2 or 3. As shown in FIG. 3, an alternate embodiment of the cover of the present invention is shown at 110 with a body 112. The operative region may also include at least a section of a headband component 15 of device 14. Preferably, cover 110 is designed to cover completely test device, and FIG. 3 shows that the cover is formed to accommodate encasement of both earphone components 14*a* and headband component 15.

Referring to FIGS. 2–3, device 14 is also referred to herein as an earphone headset with opposing earphones. The earphones, such as earphone 14*a*, are centered over the meatus 16 of a patient's ear 18.

Referring to both FIGS. 1 and 2, cover 10 is constructed for covering such an operative region of device 14 by including a closure device 20, which is preferably in the form of an elastic band that is suitably fastened to body 12 by being heat sealed, sewn, glued, or by another known fastening method. If an elastic band is not used, other fasteners are possible such as a draw string, hook-and-loop fasteners such as those sold under the trademark VELCRO, or clips.

Referring to FIG. 3, cover 110 is formed with an open end 122 that does not include a closure device like cover 10. Of course it should be understood that a closure device may also be used for cover 110 if desired.

ACOUSTIC TRANSPARENCY OF THE INVENTION

TEST I

Testing was performed to analyze for deleterious acoustic effects associated with using cover 10 on an audiometric testing device. As shown below, a control (headphone with no cover) and five test units (headphones with cover 10) were tested for distortion. A THD-39 headphone was used with an MX-41/AR cushion. The audiometer hearing level setting was 100 dB. Distortion measurements were recorded by a Quest Audiometric Analyzer, Model AA-188 (Serial No. 606004).

RESULTS

% DISTORTION (THD)

| | Control | Test Units | | | | |
|---|---|---|---|---|---|---|
| | No Cover | #1 | #2 | #3 | #4 | #5 |
| 1 KHz | 0.5 | 0.5 | 0.5 | 0.5 | 0.5 | 0.5 |
| 2 KHz | 0.3 | 0.3 | 0.3 | 0.3 | 0.3 | 0.3 |
| 4 KHz | 0.2 | 0.2 | 0.2 | 0.2 | 0.2 | 0.2 |

TEST II

A second round of tests were performed to analyze for deleterious acoustic effects associated with using cover 10 on an audiometric testing device. This round of tests focused on differences in attentuation associated with covered and uncovered earphones. Twenty-seven adult subjects (fifty ears) of varying ages and hearing acuity were tested with, and then without, a 1-mil, polyethylene earphone cover like the preferred embodiment described above. The order of testing (with, then without the cover) was alternated. Test subjects were not given any explanation of the study purpose. All thresholds were determined by the Hughson-Westlake ascending technique and were judged as reliable. Frequencies tested are shown in Table 1. Testing was accomplished in an acousticallytreated, single-walled IAC booth via a Maico MA-24B audiometer with TDH39 earphones and MX41AR cushions calibrated to ANSI 1969 standards. Each earphone cover was placed over the cushion to create a flaccid membrane condition. The earphone covers were discarded following each test.

RESULTS

TABLE 1

| Ear | Threshold differences for ears tested with, then without, cover 10: Hz 125 | 250 | 500 | 750 | 1K | 1.5K | 2K | 3K | 4K | 6K | 8K |
|---|---|---|---|---|---|---|---|---|---|---|---|
| 1 | 5 | 0 | 5 | 5 | 5 | 0 | 5 | 5 | 0 | 0 | 0 |
| 2 | −5 | 0 | 0 | 10 | 10 | 0 | 0 | 0 | 0 | 5 | 5 |
| 3 | 0 | 5 | 0 | 5 | 5 | −5 | 0 | 0 | 5 | −5 | 5 |
| 4 | 5 | 0 | 5 | 0 | −5 | 0 | 0 | 5 | −5 | 10 | 0 |
| 5 | 0 | −10 | −5 | 0 | −5 | 0 | 0 | −5 | 0 | 5 | 0 |
| 6 | 0 | −5 | 0 | 0 | 5 | 5 | 0 | 5 | 5 | 5 | 0 |
| 7 | 0 | −10 | 10 | 5 | 0 | 5 | −5 | 0 | 0 | 0 | −5 |
| 8 | 5 | 0 | −5 | −5 | 0 | 0 | 5 | 0 | −5 | 5 | 10 |
| 9 | 5 | 0 | 0 | 0 | 0 | 0 | 0 | 0 | −5 | 5 | 0 |
| 10 | 5 | 5 | 5 | 0 | 0 | −5 | 0 | −5 | 0 | 0 | −5 |
| 11 | −5 | 0 | 0 | 0 | 0 | 0 | −5 | 0 | 0 | 0 | 5 |
| 12 | 10 | 10 | 0 | 5 | 5 | 5 | 0 | 0 | 0 | 5 | 10 |
| 13 | 0 | 5 | 0 | 5 | 5 | 5 | 5 | 5 | 0 | 5 | 10 |
| 14 | −5 | −5 | 0 | 0 | 0 | 5 | 0 | 0 | 0 | 5 | 0 |
| 15 | −5 | −10 | 0 | 0 | 5 | −5 | −5 | −5 | −5 | 10 | 0 |
| 16 | 0 | 0 | 0 | 0 | 0 | 5 | 5 | 0 | 5 | −10 | −5 |
| 17 | 0 | −5 | 0 | 0 | 10 | 5 | 5 | 5 | 10 | −5 | 5 |
| 18 | −5 | 5 | 0 | 5 | 0 | 0 | 5 | 0 | 0 | 0 | 5 |
| 19 | 5 | 0 | 0 | −5 | 0 | −5 | 0 | 0 | −5 | 5 | 5 |
| 20 | 0 | −5 | 5 | 5 | 10 | 5 | 5 | 5 | 0 | 5 | 0 |
| 21 | −5 | 0 | 0 | 0 | 5 | −5 | −5 | 0 | 0 | 5 | 0 |
| 22 | −5 | 0 | 0 | 0 | 0 | 0 | 0 | 0 | 0 | 5 | 5 |
| 23 | 5 | −5 | 5 | 5 | 5 | −5 | 5 | 10 | 10 | 5 | 5 |
| 24 | 0 | 0 | −5 | 10 | 5 | −5 | 5 | 0 | −5 | 0 | 5 |
| 25 | 0 | 5 | 5 | 5 | 0 | 0 | −5 | 0 | 0 | 0 | −5 |

Table 2

Threshold differences for ears tested without, then with cover 10:

TABLE 2

| Ear | Threshold differences for ears tested without, then with cover 10: Hz 125 | 250 | 500 | 750 | 1K | 1.5K | 2K | 3K | 4K | 6K | 8K |
|---|---|---|---|---|---|---|---|---|---|---|---|
| 1 | 0 | 0 | 0 | −5 | −5 | 0 | 0 | 0 | 0 | 0 | 0 |
| 2 | 5 | 0 | 0 | −5 | 0 | −5 | −10 | 0 | −5 | 0 | −10 |
| 3 | 0 | 0 | −5 | −5 | −5 | −5 | 0 | −5 | −10 | 5 | 0 |
| 4 | 0 | −5 | −5 | 0 | 5 | 0 | −5 | −5 | −5 | 0 | −5 |
| 5 | 5 | 5 | 0 | 0 | 5 | 0 | 0 | 0 | 0 | 0 | 5 |
| 6 | 0 | 0 | −5 | 0 | −5 | −5 | 0 | 5 | 0 | 0 | 5 |
| 7 | −5 | 0 | 0 | 5 | 5 | 5 | 0 | 0 | −10 | 5 | 0 |
| 8 | 0 | 5 | 0 | 0 | 0 | 0 | −5 | −5 | −5 | 0 | 0 |
| 9 | −5 | −5 | −5 | 0 | 0 | −5 | 0 | 0 | 0 | −5 | 0 |
| 10 | −10 | −10 | 0 | −5 | 5 | 0 | 0 | −5 | −5 | 5 | 0 |
| 11 | 0 | 0 | 0 | 5 | 0 | −5 | −10 | 0 | −5 | 10 | 0 |
| 12 | 0 | 0 | 0 | 5 | 5 | 5 | 5 | 0 | 5 | −10 | 10 |
| 13 | 5 | 0 | 5 | 0 | 0 | 0 | 0 | 0 | 5 | 5 | −5 |
| 14 | 5 | 0 | 5 | 0 | 0 | −5 | 0 | −10 | −5 | −5 | 0 |
| 15 | 0 | 5 | 0 | 0 | 0 | −5 | −5 | −5 | 0 | 5 | 0 |
| 16 | 0 | −5 | 0 | 0 | −5 | −5 | −5 | 0 | −5 | −5 | 0 |
| 17 | 0 | 0 | −5 | 0 | 0 | 0 | 0 | 0 | −5 | 0 | 5 |
| 18 | −5 | −5 | −5 | 0 | 0 | 5 | −5 | 5 | 0 | 10 | 0 |
| 19 | 0 | 0 | 0 | 0 | 5 | 0 | 5 | 5 | 0 | 0 | 0 |
| 20 | 0 | 0 | −5 | 0 | 0 | 5 | 0 | 0 | 0 | 5 | 5 |
| 21 | −5 | 0 | 0 | 5 | 5 | 0 | 5 | 0 | 5 | 0 | 5 |
| 22 | 0 | 5 | 5 | 0 | 0 | 0 | 0 | 5 | 0 | 5 | 0 |
| 23 | −5 | −10 | 0 | 0 | 0 | 0 | −5 | −5 | −5 | 0 | 0 |
| 24 | −5 | −5 | 0 | 0 | −5 | 5 | 0 | 0 | 0 | 0 | 10 |
| 25 | 0 | 0 | 0 | 5 | 5 | 0 | 0 | 0 | −5 | 5 | 5 |

Table 3 displays a statistical analysis of the thresholds and the "with cover/without cover" threshold differences at all frequencies studied. At any one frequency, the "W" reflects the mean threshold for all fifty ears tested with the cover; the "WO" reflects the mean threshold for the fifty ears tested without the cover. The "Difference Mean" is simply the difference between the "with and without" cover values. Example: from Table 3, at 125 Hz, the mean threshold for all ears tested with cover 10 on was 7 dB, and for all ears tested with the cover off was 7.1 dB. The difference of-0.1 dB (cover on vs. cover off) is shown under the heading "Difference Mean". Similarly, at 250 Hz, a mean threshold of 10.8 dB was observed for all ears tested with the cover on, and a mean threshold of 11.7 dB was observed for all ears tested with the cover off. The "Difference Mean" was –0.9 dB.

TABLE 3

| Ear | Mean | Standard Deviation (Mean) | (Difference) Mean | Standard Deviation (Difference Mean) |
|---|---|---|---|---|
| W125 | 7.0000 | 12.037 | | |
| | | | –.1000 | 4.225 |
| WO125 | 7.1000 | 12.083 | | |
| W250 | 10.8000 | 11.839 | | |
| | | | –.9000 | 4.595 |
| WO250 | 11.7000 | 11.978 | | |
| W500 | 12.3000 | 14.888 | | |
| | | | .1000 | 3.424 |
| WO500 | 12.2000 | 15.022 | | |
| W750 | 12.6000 | 16.850 | | |
| | | | 1.0000 | 3.642 |
| WO750 | 11.6000 | 16.050 | | |
| W1K | 12.7000 | 15.754 | | |
| | | | 1.4000 | 4.046 |
| WO1K | 11.3000 | 15.044 | | |
| W1.5K | 11.0000 | 12.697 | | |
| | | | –.2000 | 3.774 |
| WO1.5K | 11.2000 | 13.422 | | |
| W2K | 11.5000 | 14.957 | | |
| | | | –.2000 | 4.160 |
| WO2K | 11.7000 | 14.590 | | |
| W3K | 18.3000 | 18.031 | | |
| | | | .1000 | 3.710 |
| WO3K | 18.2000 | 17.577 | | |
| W4K | 22.3000 | 22.067 | | |
| | | | –.8000 | 4.328 |
| WO4K | 23.1000 | 21.235 | | |
| W6K | 30.4000 | 21.209 | | |
| | | | 2.2000 | 4.536 |
| WO6K | 28.2000 | 21.087 | | |
| W8K | 29.0000 | 27.011 | | |
| | | | 1.7000 | 4.473 |
| WO8K | 27.3000 | 26.596 | | |

ANTI-VIRAL CAPABILITY OF THE INVENTION

To test the anti-viral capability of the invention, tests were performed to measure the ability of body 12 to prevent viral penetration. The tests involved placing a viral suspension with a concentration of greater than $1\times10^6$ Plaque Forming Units/mL (PFU/mL) on the surface of the test sample in an assay plate. The challenge organism used was the ϕX174 bacteriophage ATCC#13706-B1. The test incorporated the viral challenge into sterile simulated serum to simulate the surface tension effects of serum. Test samples were exposed to the challenge for up to 1 hour.

Challenge Preparation:

100 mL of tryptone broth was inoculated with *E. coli* C and incubated 18 hours at 37° C.±2° C. with shaking. The culture was diluted 1 to 100, incubated for approximately 90 minutes, and then inoculated with 0.5 mL of the ϕX174 phage stock. The culture was incubated for 1–5 hours with rapid shaking. After complete *E. coli* C. lysis, the phage culture was centrifuged at 5000×G and filtered first through a 0.45 μm filter and then a 0.2 μm filter. The stock culture was held at 2°–8° C.

Test Procedure:

The simulated serum was inoculated with the ϕX174 bacteriophage so that the challenge concentration was approximately $10^6$ PFU/mL. Test samples of body 12 were cut into approximately 80 mm diameter swatches (3 and ¼ inches) and placed onto the surface of bottom agar plates overlaid with E. Coli C. A 100 μL aliquot of the challenge was placed onto the surface of the test swatch and then covered with a glass cover slip (approx. ⅝ inches). The swatch samples were removed at 10 and 60 minutes.

The plates were incubated at 37° C. ±2° C. for 4–18 hours. The plates were scored as negative if no plaques were visible on the assay plates or positive if plaques were present.

Test Controls:

Negative controls consisted of placing a 100 μL aliquot of the challenge onto polyethylene swatches for 60 minutes then removing agar plate and incubating the plates as in the test procedure. Positive controls used 2 ply muslin as the test material with samples removed after 60 minutes. Negative controls were performed by placing test swatches onto assay plates for 60 minutes without adding the inoculum.

The test results are as follows. The average titer of the ϕX174 challenge suspension was $2.5\times10^8$ pFU/mL. This is a very high challenge, and exceeds what would be expected in most clinical situations. The triplicate results of body 12 showed no viral penetration occurring on the assay plates, indicating that the samples were effective barriers to the virus challenge throughout the 60-minute exposure time. With respect to the test controls, the challenge virus did not penetrate the negative control material (polyethylene) after 60 minutes. The positive control material (paper) showed penetration of the challenge virus after 60 minutes of exposure.

Operation and Preferred Method of Practicing

Referring again to FIGS. 1 and 2, cover 10 is packaged in a suitable, conventional sterile package, and then removed by the health care professional using standard sterile protocol. Cover 10 is easily placed over the operative region of the earphone headset, such as region 14*a*. After the audiometric test procedure is completed, the professional simply removes cover 10 and disposes of it. Use of cover 10 does not affect calibration of the audiometer.

To practice the method of the invention, the user selects a material such as polyethylene which has substantially anti-viral, acoustically transparent properties. The user forms the material into two earphone covers, such as cover 10, and places each cover over a corresponding one of the patient's ears.

The present invention achieves the above objects by providing both apparatus and method that overcomes the drawbacks of prior-art systems. Cover 10 and the method of the invention provides a safe test environment for patients of audiologists. The method also allows for repeatedly sterilizing those sections of audiometric devices which come into contact with patients' ears. Cover 10 is lightweight and comfortable for the patient, and the method of using it is not time-consuming. The material choice of 1-mil thick polyethylene makes the invention capable of being cost-effectively manufactured and practiced.

Accordingly, while a preferred embodiment of the invention has been described herein, it is appreciated that modifications are possible that are within the scope of the invention.

I claim:

1. An anti-viral, acoustically transparent audiometer headset system connectable to audiometric sound testing equipment, comprising:

an audiometer headset including opposing earphones, each centerable over the meatus of a patient's ear, and each being operable to transmit audiometric sounds into such patient's ear when connected to such audiometric-sound-testing equipment;

prophylactic structure formed as dual bodies each of a substantially acoustically-transparent material, and each constructed for covering one of the earphones; and wherein each body exhibits the following approximate ranges of % distortion in total harmonic distortion (THD) at the following frequencies when the bodies are placed over the earphones, and wherein such audiometric-sound-testing equipment has a hearing level setting which is set at 100 dB:

| FREOUENCY (KHz) | % DISTORTION (THD) |
|---|---|
| 1 | 0.4–0.6 |
| 2 | 0.2–0.4 |
| 4 | 0.1–0.3. |

2. The system of claim 1 wherein each body is formed as a film.

3. The system of claim 1 wherein each body is made of polyethylene.

4. The system of claim 3 wherein each body has a thickness of approximately 1 mil.

5. A method of preventing patient cross-contamination associated with audiometric testing that utilizes audiometric-sound-testing equipment and an audiometer earphone headset with opposing earphones, each to be centered over the meatus of a patient's ears, comprising:

selecting a material having substantially anti-viral, acoustically transparent properties;

forming the material into two earphone covers;

placing each cover over a corresponding earphone; and performing such audiometric testing with each cover exhibiting the following approximate ranges of % distortion in total harmonic distortion (THD) at the following frequencies when the covers are placed over the earphones, and wherein such audiometric-sound-testing equipment has a hearing level setting which is set at 100 dB:

| FREOUENCY (KHz) | % DISTORTION (THD) |
|---|---|
| 1 | 0.4–0.6 |
| 2 | 0.2–0.4 |
| 4 | 0.1–0.3. |

* * * * *